US005400831A

United States Patent [19]

Gheysen

[11] Patent Number: 5,400,831

[45] Date of Patent: Mar. 28, 1995

[54] METHOD AND WEAVING LOOMS FOR MANUFACTURE OF FACE TO FACE FABRIC

[75] Inventor: Nico Gheysen, Sint-Eloois-Winkel, Belgium

[73] Assignee: N.V. Michel van de Wiele, Kortrijk-Marke, Belgium

[21] Appl. No.: 36,492

[22] Filed: Mar. 24, 1993

[30] Foreign Application Priority Data

Apr. 10, 1992 [BE] Belgium ..... 09200324

[51] Int. Cl.[6] ..... D03D 39/16; D03D 27/06

[52] U.S. Cl. ..... 139/21; 139/398

[58] Field of Search ..... 139/2, 7 R, 21, 397, 139/398

[56] References Cited

U.S. PATENT DOCUMENTS

| | | | |
|---|---|---|---|
| 3,327,738 | 6/1967 | Sabbe | 139/398 |
| 3,519,032 | 7/1970 | Sabbe | 139/398 |
| 4,756,340 | 7/1988 | Janssen | 139/397 |
| 5,123,455 | 6/1992 | Maina | 139/452 |

FOREIGN PATENT DOCUMENTS

| | | |
|---|---|---|
| 362433 | 4/1990 | European Pat. Off. . |
| 460756 | 12/1991 | European Pat. Off. . |
| 790942 | 11/1935 | France . |
| 2182790 | 12/1973 | France . |

*Primary Examiner*—Andrew M. Falik
*Attorney, Agent, or Firm*—Ladas & Parry

[57] ABSTRACT

A method for twin-spool manufacture of a two-shot face-to-face fabric comprising a top fabric and a bottom fabric including binder warp threads for forming the upper and lower fabrics respectively and pile warp threads bound as dead pile threads into the top fabric or into the bottom fabric for successive picks or passed as active pile threads between the top and bottom fabrics in successive picks. In successive picks there are formed alternately a shed between binder warp threads providing the top fabric and a shed between binder warp threads providing the bottom fabric with the insertion of two weft threads, one above the other, in each of said sheds. The two weft threads are taken to a height corresponding to the top fabric before insertion into the shed of the top fabric and then are taken to a lower height corresponding to the bottom fabric before insertion into the shed corresponding to the bottom fabric. A corresponding weaving loom enables the two weft insertion devices supported one above the other to move up and down together to carry out the method.

10 Claims, 4 Drawing Sheets

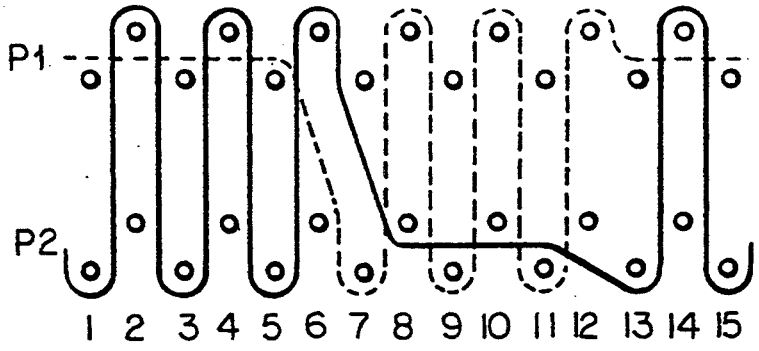
FIG. 1
PRIOR ART
FIG. 2
PRIOR ART
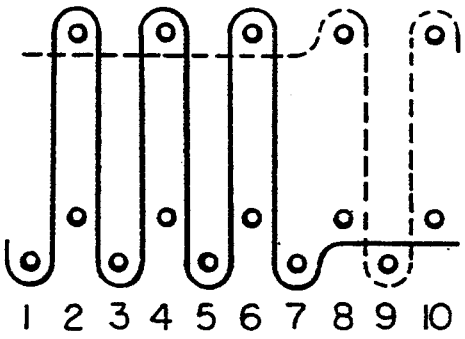
FIG. 5
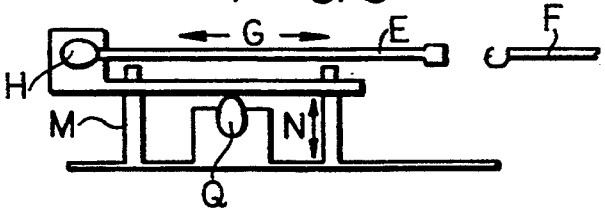

METHOD AND WEAVING LOOMS FOR MANUFACTURE OF FACE TO FACE FABRIC

BACKGROUND OF THE INVENTION

The invention relates, on the one hand, to a two-shot weave for the manufacture of face-to-face fabrics without mixing contours, in which each pile loop can have a different color, and to face-to-face fabrics which are woven with such a weave.

The invention relates, on the other hand, to 10 face-to-face weaving looms which are provided with two or more weft insertion devices which can perform an up and down movement during weaving, for the purpose of, in succession at two different levels, each inserting weft threads through a shed formed between warp threads, for weaving the two-shot weave according to the invention.

DESCRIPTION OF PRIOR ART

A brief description will be given below of how face-to-face fabrics are manufactured using known face-to-face weaving looms, in order to clarify the current state of the art in the field of the invention.

Two base fabrics—called the top fabric and bottom fabric—are woven above one another by interweaving warp threads extending next to each other at two levels with weft threads directed at right angles thereto. Before each pick (insertion of a weft thread between the warp threads), at the place where the pick is to take place, each warp thread is drawn either above the pick height or below the pick height. A weft thread is inserted in the shed, between the two groups of warp threads. It extends in the end over the entire width of the fabric. The desired weave between warp threads and weft threads is obtained by selecting the positions of the various warp threads before each pick. The above takes place at the level of a top series of warp threads, in order to form the top fabric, and at the level of a bottom series of warp threads, in order to form the bottom fabric. For this, the existing weaving looms are provided with, for example, one weft insertion device, comprising two grippers—a giver and a taker—which are disposed on either side of the warp threads at the same fixed height. Both grippers are inserted in the shed simultaneously, while a weft thread is taken along by one of the grippers—the giver. The two grippers meet each other in the shed, and the weft thread is passed from one gripper to the other—the taker. Both grippers are then moved out of the shed, so that the weft thread in the end extends from one side of the shed to the other. In the case of weaving looms with a single weft insertion device it is ensured through the position of the warp threads that picking takes place alternately in the top fabric and the bottom fabric. In the case of so-called double-gripper weaving looms two gripper devices are provided one above the other, disposed at a fixed height, so that respective weft threads can be inserted simultaneously into the top fabric and the bottom fabric. This is called double picking.

For the formation of the pile of face-to-face fabrics, pile warp threads are bound in succession into top fabric and bottom fabric by the weft threads in such a way that they run from one base fabric to the other. These pile threads are subsequently cut through between the two base fabrics. Several pile warp threads of different colors are provided in order to obtain patterns in the pile. If at a particular point in the fabric one pile warp thread is running between bottom fabric and top fabric (is active), then the other pile warp threads are bound into one of the base fabrics at that point (running parallel to the warp threads), in such a way that they are invisible along the top side (the pile side) of the fabric. These pile threads are called dead pile threads. Only the active pile thread is visible, so that it determines the color of the fabric at that point. For this, use is made of a jacquard mechanism, which can determine the position of each pile thread individually before each pick. The control data for the jacquard mechanism are consequently determined depending on the desired pattern and the desired weave for the pile threads.

The known face-to-face weaving looms are provided with a number of weaving frames which are movable up and down, and are each designed to take along a number of warp threads during these movements. By controlling these weaving frames, the correct positions of the various warp threads are determined relative to the pick height so that the base fabrics are woven according to the desired weave. The movement of these weaving frames takes place, for example, by means of cams.

In a so-called two-shot weave the active pile threads are bound into the top fabric and bottom fabric in succession in such a way that their position relative to the successive weft threads is repeated after every two shots (a "pattern repeat" as used herein). In order to illustrate the prior art, with regard to the weave according to the invention, a known two-shot weave is shown in a diagrammatic cross-section in FIG. 1. In this figure the weft threads are lying at right angles to the plane of the page, and they are seen in cross-section. The warp threads are lying in the plane of the page. They are seen in solid lines. The binder warp threads—which are interwoven with the weft threads—and any tension warp threads are not shown. Only the pile warp threads ($P_1$, $P_2$) are shown. This weave is woven with double picking. The successive double picks are numbered at right angles below them in the figure.

The pile thread ($P_2$) is active over the first six (double) picks, and from pick (7) onwards is bound into the bottom fabric, while from pick (13) onwards it becomes active again.

The pile thread ($P_1$) is bound into the top fabric over the first six picks, is active over the following six picks (7 to 12), and is then bound into the top fabric again from pick (13) onwards.

This weave can be woven by making two different positions of the pile warp threads relative to the grippers possible on each shot. In order to bind a pile warp thread into the top fabric: positions "above" (the two grippers and "midway" (between the two grippers). In order to bind into the bottom fabric: position "below" and "midway", and in order to form pile: positions "above" and "below". The weave shown in FIG. 1 is obtained by combining these positions one after the other by means of a jacquard machine.

The disadvantage of this weave lies in the fact that so-called mixing contours occur. A mixing contour occurs at the transition between two different color fields. If a pattern repeat (shot 5 - 6) with pattern-forming pile ($P_2$) which is bound into the bottom fabric on pattern repeats where said pile thread ($P_2$) is not pattern-forming (for example, shot 9 - 10) is followed by a pattern repeat (shot 7 - 8) with pattern-forming pile ($P_1$) which is bound into the top fabric on pattern repeats where said pile thread ($P_1$) is not pattern-forming (for example, shot 1 - 2), then a mixing contour occurs at the transition between these pattern repeats (in FIG. 1 shot 5 - 6, followed by shot 7 - 8). This means that, at the dividing point of a color field on the fabric formed by pile thread ($P_2$) and a color field formed by pile thread ($P_1$), mixing of the colors occurs on the color field periphery. The clear dividing line between these two color fields is marred by the fact that a side of the last pile loop of pile thread ($P_2$) extends at an angle inside the color field of pile thread ($P_1$), and by the fact that a side of the first pile loop of pile thread ($P_1$) extends at an angle inside the color field of pile thread ($P_2$). This imperfect transition between two color fields is called a mixing contour.

A number of solutions are known for avoiding these mixing contours. A first known method for avoiding mixing contours is to provide 3 different positions per shot for the pile warp threads. This method requires for each pile thread a lifting device which interacts with two hooks of the jacquard machine to make these three positions possible.

The disadvantage of this solution is that we need a double capacity of the jacquard machine, which makes this solution very expensive.

Another known solution is to leave out a pile point. The selection of the new active pile is deferred for one shot, while the first pile thread is already bound in. The result can be seen in FIG. 2. The mixing contours no longer occur. A disadvantage of this method is, however, that one color point now corresponds to 4 shots (instead of 2). The pattern fineness is consequently halved. Another disadvantage is that only half the pile density is obtained when there is a color change.

Another known solution is described in Belgian Patent Application No. 09000563, filed on 05 Jun. 1990, and is based on the principle that the working pattern repeat imposed for the pile warp threads goes over 3 shots, while the working pattern repeat of the basic weave goes over only two shots.

SUMMARY OF INVENTION

An object of the invention is to utilize a two-shot weave which can be woven with double picking without mixing contours, and in which each pile loop can be a different color, while none of the above-mentioned disadvantages occur.

A subject of the invention is, on the one hand, the utilization of a two-shot weave without mixing contours and, on the other, a weaving loom with two or more vertically movable grippers, provided for achieving the weave according to the invention, while weaving with this weaving loom gives additional advantages. In the process of the invention the two-shot weave produces a face-to-face fabric which receives two weft threads one above the other alternately in the top fabric and in the bottom fabric. A dead pile thread lies between these two weft threads, parallel to the fabric. An active pile thread runs in succession above the two weft threads in the top fabric and below the two weft threads in the bottom fabric, and so on.

The problem of the mixing contour occurs in general when there is a color transition where an active pile thread is bound into one of the fabrics, and where another pile thread which was previously bound into the other fabric begins to run to the first-mentioned fabric in order to form pile.

In the case of the two-shot weave produced according to the invention, the situation is as follows for a color transition: At the last shot where it is active, the active pile thread lies above the two weft threads of the top fabric or below the two weft threads of the bottom fabric, and at the next shot is bound in between the two weft threads of the bottom fabric, or the top fabric, and for the rest remains bound into the same fabric in that way. Both in the top fabric and in the bottom fabric, this pile thread lies between inner shots (weft threads lying along the pile side of the fabric) which belong to successive shots, with the result that the pile sides, after being cut through, are held essentially at right angles relative to the plane of said fabrics.

The other pile thread which was bound in before the transition and becomes active after the transition, at the last shot where it is bound in lies between the weft threads lying above one another in the top fabric or in the bottom fabric, and at the next shot runs above the two weft threads of the top fabric or below the two weft threads of the bottom fabric, and for the rest runs back and forth—in each base bound off in the above-mentioned way—between the two fabrics so long as said pile thread remains active.

This pile thread in both the top fabric and the bottom fabric lies between adjacent inner shots belonging to successive shots, with the result that the pile sides, after being cut through, are held essentially at right angles relative to the plane of the fabrics.

The above-described process according to the invention can be carried out using a weaving loom with two weft insertion devices moving vertically up and down, which forms another subject of the invention. The use of such a weaving loom also provides additional advantages, which will be discussed further on in this description. The movement of these weft insertion devices is synchronized by known means with the cycles of the weaving frames, the weft thread being inserted alternately at one of two different heights of each successive shed so as to coordinate with the movement of one of the weaving frames in each case. The problems solved by this invention are that the pile length is no longer dependent on the amplitude of movement of the weaving frames, that the cams which control the movement of the weaving frames can be provided with less steep sides, and that a fabric with a pile which is flatter is obtained.

The weaving loom according to the invention has two or more weft insertion devices which are disposed above one another so that they are movable vertically, and which move up and down together according to a specific cycle. For the manufacture of a fabric with the weave according to the invention, the up and down movement of the weft insertion devices is such that at the top position of the weft insertion devices, the bottom gripper device is standing approximately in the middle position (at the halfway point of the levels to which the two fabrics extend), and that in the bottom position of the weft insertion devices the top weft insertion device is standing in the above-mentioned middle position.

This weaving loom gives the following additional advantage: the tension warp threads and the dead pile warp threads always remain at the same height. The weaving frames of the tension warp threads consequently do not have to carry out any lifting. Due to the fact that no lifting has to be carried out for binding in a dead pile warp thread, it becomes possible to achieve this weave with a single-lift jacquard machine (two possible positions for each pile thread per shot: either above, or below the gripper devices). This jacquard machine can then, for example, be made up of two parts, one part for the top fabric, one part for the bottom fabric.

The middle position of the invention (at the level of the tension warp) in the top fabric is in this case the rest position for the jacquard hooks.

Another advantage of this weaving loom lies in the fact that the weaving frames of the binder warps have twice as much time to cross as was the case with the known weaving looms, due to the fact that these weaving frames do not have to carry out any lift. At the moment that the grippers insert wefts in the bottom fabric, the weaving frames of the binder warps of the top fabric cross, and vice versa.

The result of the above-mentioned advantages is that the energy consumption of this weaving loom can be lower than that of the known weaving looms.

Finally, it is also an advantage that the weaving frames only have to move at half speed, and that the dead pile warp threads remain immovable, which, of course, has its effect on the wear of parts, breakage of warp threads, etc.

Further advantages and features of the method for producing a weave according to the invention and of the weaving loom for achieving said weave will be illustrated with reference to the detailed description thereof which follows, but this does not restrict the invention to the specific examples and embodiments which are explained in this description.

BRIEF DESCRIPTION OF THE DRAWINGS

FIG. 1 shows a diagrammatic cross-section of a face-to-face fabric, woven according to a two-shot weave with double picking, to clarify the problem of the mixing contours in the prior art.

FIG. 2 shows a diagrammatic cross-section of a face-to-face fabric according to a two-shot weave with double picking, in which according to the prior art a mixing contour is avoided by deferring the selection of the new active pile for one shot.

FIG. 5 shows a schematic diagram for a mechanism for vertically moving the weft insertion devices according to a specific cycle.

DESCRIPTION OF THE PREFERRED EMBODIMENT

Figure 3A:
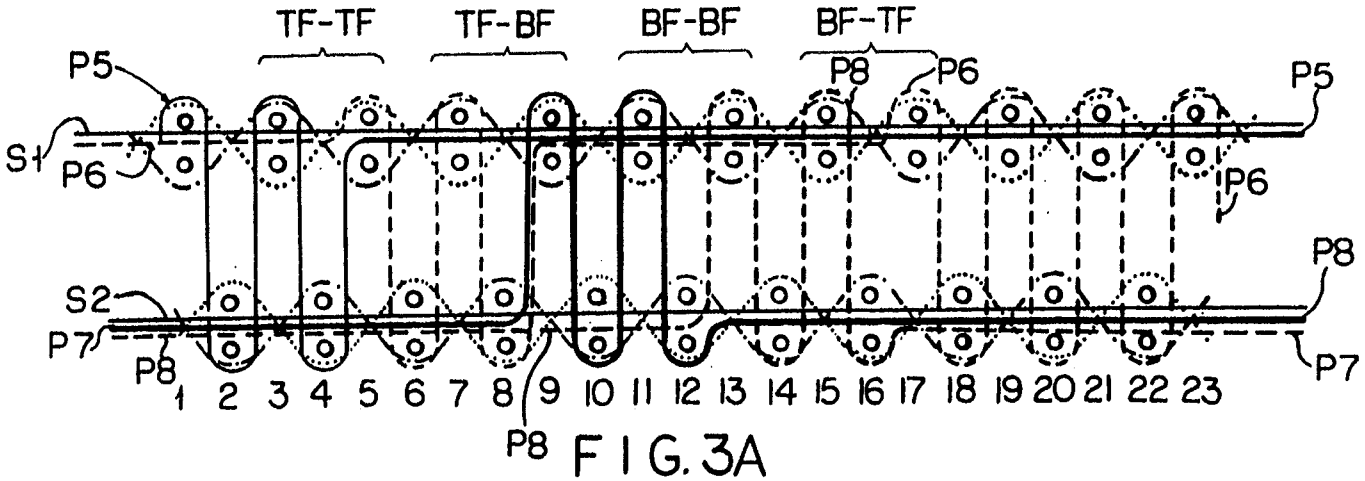
FIG. 3*a* shows a diagrammatic cross-section of a face-to-face fabric woven according to a two-shot weave with double picking according to the invention, with the various possible color transitions.
Figure 3B:
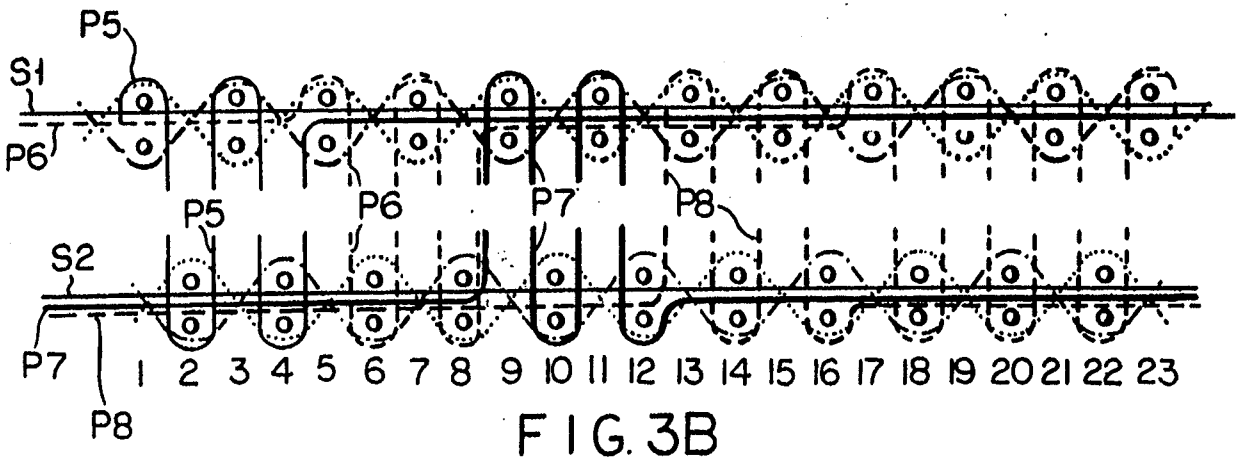
FIG. 3*b* shows a diagrammatic cross-section of the face-to-face fabric according to the invention of FIG. 3*a*, after cutting through of the pile threads.

In the case of the weave for manufacturing face-to-face fabrics according to the invention (see FIGS. 3*a* and 3*b*) weaving takes place with double picking, while the pile warp threads are woven with the weft threads according to a two-shot weave. In FIGS. 3*a* and 3*b* four pile warp threads ($P_5$, $P_6$, $P_7$, $P_8$) are provided, two of which ($P_5$, $P_6$) are bound into the top fabric in the pattern repeats where they are not active, and two of which ($P_7$, $P_8$) are bound into the bottom fabric if they are not active. In the description which follows we indicate that a certain pile thread is bound as dead pile into the bottom fabric (BF) or top fabric (TF) by placing BF or TF in parentheses after the reference of the pile thread. The following transitions between the indicated pile threads as active are shown in FIGS. 3*a* and 3*b*:

From $P_5$ (TF) to $P_6$ (TF): 3-4 followed by pattern repeat 5-6

From $P_6$ (TF) to $P_7$ (BF): pattern repeat 7-8 followed by pattern repeat 9-10

From $P_7$ (BF) to $P_8$ (BF): pattern repeat 11-12 followed by pattern repeat 13-14

From $P_8$ (BF) to $P_6$ (TF): pattern repeat 15-16 followed by pattern repeat 17-18.

The weave is formed both in the top fabric and in the bottom fabric by a succession of pairs of weft threads lying above one another, which we indicate by the serial number of the shot with which they are inserted (1 to 23), each weft thread being indicated as top or bottom of the indicated pair. A pattern repeat is formed by two successive shots, and is also indicated by the serial numbers of said successive shots: for example, shot 3-4 (see above). The dead pile warp threads are bound in between the top and bottom weft thread of a pair of weft threads lying one above the other. The active pile warp threads lie successively above a top weft thread in the top fabric and below a bottom weft thread of the following shot in the bottom fabric. When a pattern repeat (e.g. 3-4) in which a pile thread $P_5$ (TF) is active is followed by a pattern repeat (5-6) in which a pile thread $P_6$ (TF) is active, the pile thread $P_5$ (TF) is bound into the top fabric already at the fifth shot, and the pile thread $P_6$ (TF) is brought into the top fabric above the top weft thread of the 5th shot, and subsequently extends to the bottom fabric to continue forming pile.

No mixing contours occur, since each pile side extends virtually at right angles to the plane of the fabrics and remains within its own color field after the active pile threads between the two fabrics have been cut through. A neat demarcation is obtained between two color fields.

When a pattern repeat (7-8) in which a pile thread $P_6$ (TF) is active is followed by a pattern repeat (9-10) in which a pile thread $P_7$ (BF) is active, the pile thread $P_6$ (TF) is bound into the top fabric already at the ninth shot, and the pile thread $P_7$ (BF) is brought to the top fabric already between the eighth and ninth shot of the bottom fabric, and is subsequently guided above the top weft thread of the ninth shot to continue forming pile. In the case of this transition also, no mixing contours are visible in the fabrics after the active pile threads between the two fabrics are cut through (see FIG. 3*b*).

When a pattern repeat (11-12) in which a pile thread $P_7$ (BF) is active is followed by a pattern repeat (13-14) in which a pile thread $P_8$ (BF) is active, the pile thread $P_7$ (BF), after being inserted in the bottom fabric below the bottom weft thread of the twelfth shot, is bound into the bottom fabric at the next shot—shot 14. The pile thread $P_8$ (BF) is already inserted in the top fabric above the top weft thread at the thirteenth shot, and from then on goes on forming pile. In the case of this transition also, no mixing contours are visible in the fabrics after the active pile threads between the two fabrics are cut through (FIG. 3*b*).

When a pattern repeat (15-16) in which a pile thread $P_8$ (BF) is active is followed by a pattern repeat (17-18) in which a pile thread $P_6$ (TF) is active, the pile thread $P_8$ (BF), after being inserted in the bottom fabric below the bottom weft thread of the sixteenth shot, is bound into the bottom fabric at the next shot—shot 18. The pile thread $P_6$ (TF) is already inserted above the top weft thread of the seventeenth shot, and from there runs to the bottom fabric to continue forming pile. In the case of this transition also, no mixing contours are visible in the fabrics after the active pile threads between the two fabrics are cut through.

For achieving such a weave according to the invention, a weaving loom is provided with two weft insertion devices, such as, for example, gripper devices, which can move up and down vertically.

This movement is achieved with known means such as, for example, a cam system, so that both devices together carry out an up and down movement, while their cycle of movement is such that a double pick occurs when the weft insertion devices have gone into a top position, and the next pick occurs when the weft insertion devices have gone into a lower position, and so on. The movements of the jacquard mechanism and of the weaving frames are controlled here in such a way that in each case they take the pile warp threads or the binder warp threads and tension warp threads into the correct position relative to the pick heights, so that the two weft threads in each case both lie in top fabric or in bottom fabric, and so that the pile warp threads, the binder warp threads and tension warp threads lie relative to the weft threads in accordance with the weave according to the invention. European Patent Application No. 88116629.2, published under 0362433, describes a weaving loom which is provided with a single device moving up and down for inserting the weft threads through the shed. FIG. 5 shows schematically in this publication how a cam system can control the up and down movement of a pair of weft insertion devices which are mounted together one above the other. A weft pusher rod E (associated with a weft pulling rod F provided with grippers for gripping the yarn) is driven reciprocatingly along G transverse to the direction of advancement and in the plane of the fabrics by the action of a cam H. The movement G can also be obtained indirectly, for example by using a drive pinion on a rack rigid with said rod. The alternating movement of the drive pinion can be obtained by association with the usual cams (H). This entire transverse control mechanism for the weft can itself be cyclically raised along N by the said of vertical guides M and a further cam Q synchronized with all other cams of the loom.

Figure 4A:
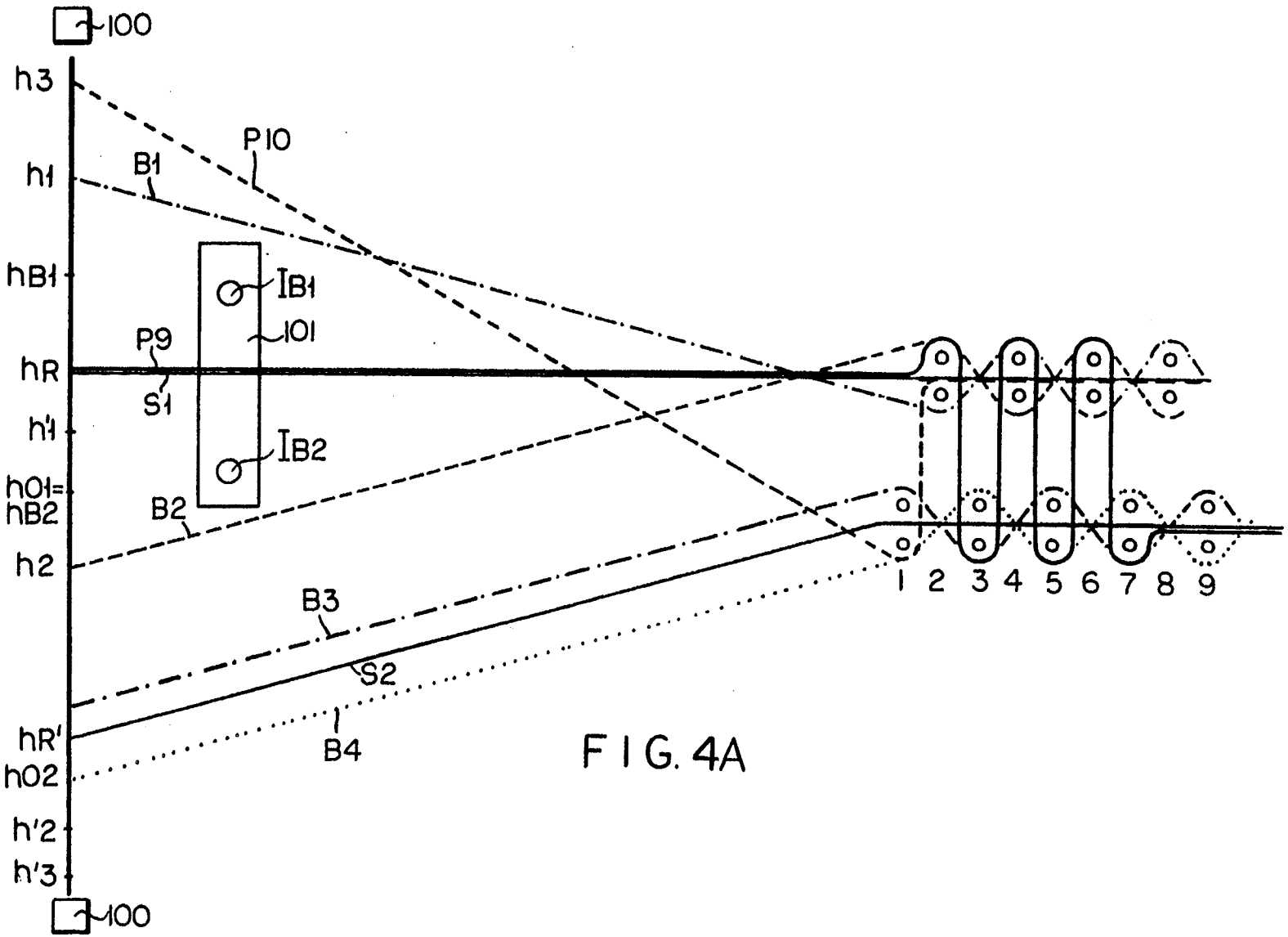
FIGS. 4*a* and 4*b* show in a diagrammatic cross-section the positions of the weft threads and of the warp threads relative to said weft threads in the case of two successive double picks during the manufacture of a face-to-face fabric according to the weave according to the invention.
Figure 4B:
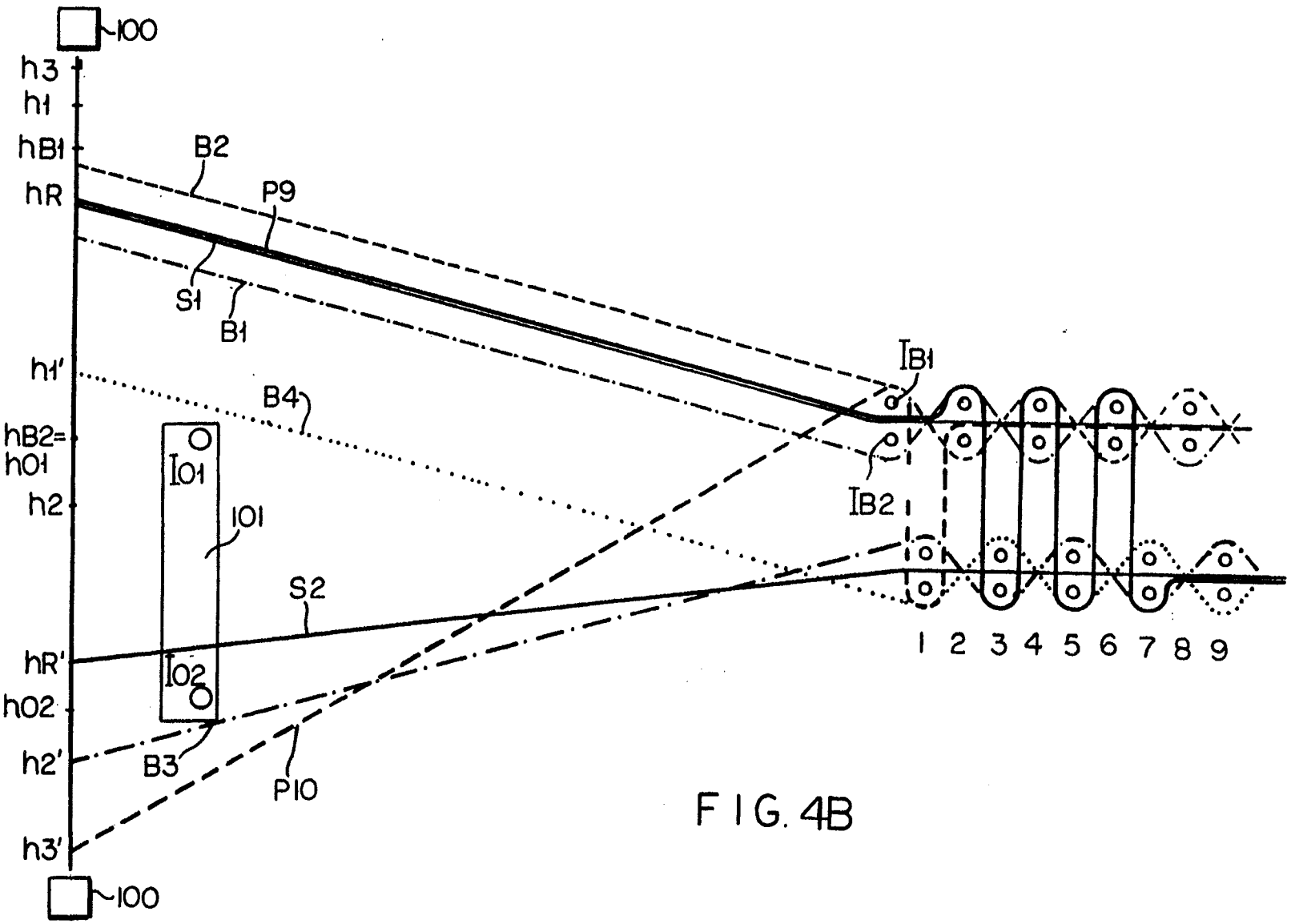

The way in which the weave according to the invention is achieved by means of the weaving loom according to the invention is illustrated with reference to the example which follows (see FIGS. 4*a* and 4*b*). The weaving frames 100 are illustrated schematically and carry respective heddles which control the heights $h_R$, $h_R'$, $h_1$, $h_2$, $h_1'$, $h_2'$, $h_3$ and $h_3'$ to which the warp threads are taken during the weaving described below. A pair of weft insertion devices 101 carry upper weft ($I_{B1}$;$I_{O1}$) and lower weft $I_{B2}$;$I_{O2}$), respectively, together in an up and down movement. In these figures a fabric part (shot 1 to 9) woven in accordance with the weave according to the invention is shown in a diagrammatic representation of a cross-section, and the positions of the various warp threads are shown relative to the weft threads in the case of two successive double picks at two different heights, in order to achieve the weave according to the invention.

For the sake of clarity of the description of this example which follows, a reference axis has been provided to the left of the weft threads in the drawing, in order to indicate the different heights of the warp threads relative to the weft threads. The following are indicated on said reference axis:

$h_R$=fixed height at which the tension warp thread ($S_1$) of the top fabric and any dead pile warp threads ($P_9$) which are bound into the top fabric are situated during the weaving.

$h_R'$=fixed height at which the tension warp thread (height $S_2$) of the bottom fabric and any dead pile warp threads which are bound into the bottom fabric are situated during the weaving.

$h_{B1}$=pick height of the top weft thread at the highest position of the weft insertion device.

$h_{B2}$=pick height of the bottom weft thread at the highest position of the weft insertion device.

$h_{O1}$=pick height of the top weft thread at the lowest position of the weft insertion device.

$h_{O2}$=pick height of the bottom weft thread at the lowest position of the weft insertion device.

$h_1$=height to which one binder warp ($B_1$) of the top fabric is taken for the insertion in that fabric.

$h_2$=height to which the other binder warp ($B_2$) of the top fabric is taken for the same insertion in that fabric.

$h_1'$=height to which one binder warp ($B_3$) of the bottom fabric is taken for the insertion in that fabric.

$h_2'$=height to which the other binder warp ($B_4$) of the bottom fabric is taken for the same insertion in that fabric.

$h_3$=height to which an active pile thread in the top fabric is taken to bind it off.

$h_3'$=height to which an active pile thread in the bottom fabric is taken to bind it off.

In the case of shot (1) of the fabric already formed (see FIGS. 4*a* and 4*b*), the pile warp thread ($P_{10}$) is active, and the pile warp thread ($P_9$) must be bound further into the top fabric. Shot (1) was inserted in the bottom fabric, so that the next shot ($I_{B1}$, $I_{B2}$) must be inserted in the top fabric. For this, at the next shot—weft threads $I_{B1}$ and $I_{B2}$—the weft insertion device is moved into its top position. Before the insertion takes place, the dead pile thread ($P_9$) and the tension warp thread ($S_1$) must extend at the height $h_r$. The binder warp threads ($B_1$) and ($B_2$) cross each other and are placed at the heights ($h_1$) and ($h_2$), respectively. The active pile thread ($P_{10}$) is placed at the height ($h_3$).

These different positions are such that the binder warp ($B_1$) and the pile thread ($P_{10}$) extend above the pick height ($h_{B1}$) of the top weft thread ($I_{B1}$), and that the dead pile warp thread ($P_9$) and the tension warp thread ($S_1$) extend between the pick heights ($h_{B1}$ and $h_{B2}$) of the weft threads ($I_{B1}$) and ($I_{B2}$), and that the binder warp ($_{B2}$) extends below the pick height ($h_{B2}$) of the bottom weft thread ($I_{B2}$). When these positions are reached the pick ($I_{B1}$ and $I_{B2}$) takes place.

At the next shot the weft threads ($I_{O1}$) and ($I_{O2}$) must be inserted in the bottom fabric. For this the weft insertion device 101 is taken into its lowest position, in such a way that the top weft thread ($I_{O1}$) goes to a height ($h_{O1}$) which is the same as the height ($h_{B2}$) of the bottom weft thread ($I_{B2}$) when the weft insertion device 101 is in its top position.

Before the pick takes place, the tension warp thread ($S_2$) must extend at the height ($h_R'$). The binder warp threads ($B_3$) and ($B_4$) cross each other and are placed at the respective heights ($h_2'$) and ($h_1'$). The active pile thread ($P_{10}$) is placed at the height ($h_3'$).

These different positions are such that the binder warp thread ($B_4$) extends above the pick height ($h_{O1}$) of the top weft thread ($I_{O1}$), that the tension warp thread extends between the pick heights ($h_{O1}$) and ($h_{O2}$) of the weft threads ($I_{O1}$) and ($I_{O2}$), and that the binder warp thread ($B_3$) and the active pile thread ($P_{10}$) extend below the pick height ($h_{O2}$) of the bottom weft thread ($I_{O2}$). When these positions are reached the pick ($I_{O1}$ and $I_{O2}$) takes place.

After the pick ($I_{O1}$ and $I_{O2}$) in the bottom fabric has taken place, the binder warp threads ($B_3$, $B_4$) of the bottom fabric can already be placed in their position for the following pick in the bottom fabric, while the pick in the top fabric ($I_{B1}$ and $I_{B2}$) is being achieved.

After the pick in the top fabric ($I_{B1}$ and $I_{B2}$) has taken place, the binder warp threads ($B_1$, $B_2$) of the top fabric can already be placed in their position for the following pick in the top fabric, while the pick ($I_{O1}$ and $I_{O2}$) in the bottom fabric is being achieved.

The weaving frames of the binder warp threads consequently have twice as much time to cross each other as is the case in a weave where a weft thread has to be bound into top fabric and bottom fabric after each shot.

Another advantage is that the tension warp threads ($S_1$) and ($S_2$) always remain in the same position (height $h_R$ or $h_R'$), so that these weaving frames carry out no lift. The tension warp threads are used here to pull the two fabrics apart.

A further advantage is that the dead pile warp threads can always remain at the same positions ($h_R$ or $h_R'$)—at the level of the tension warp threads—in order to be bound into top fabric or bottom fabric. This makes it possible to produce the weave according to the invention with a single-lift jacquard machine (two-position jacquard machine). The latter can be, for example, composed of two parts, one part for the top fabric and one part for the bottom fabric. The position in which the warp threads are taken to the height ($h_R$) is the rest position for the jacquard hooks.

An additional advantage is the fact that the energy consumption of the machine during weaving as described above can be lower than that of the known machines.

Finally, other advantages are, on the one hand, that the dead pile threads do not move and, on the other, that the weaving frames of the binder warp threads only have to move at half speed, which has its effect on the wear of parts, thread breakage, and so forth.

I claim:

1. Method for twin-spool manufacture of a two-shot face-to-face fabric comprising a top fabric and a bottom fabric which comprises alternately:

(a) forming a shed between two sets of warp threads providing the top fabric and inserting two weft threads lying one above the other through said shed;

(b) forming a shed between two sets of warp threads corresponding to the bottom fabric and inserting two weft threads lying one above the other through the shed corresponding to the bottom fabric, said steps (a) and (b) representing successive picks of the resulting top and bottom fabrics, and which includes:

(c) providing active pile threads alternately above the two weft threads in the top fabric in one pick and providing said active pile threads below the two weft threads in the bottom fabric in a subsequent pick, and (d) at each pick providing dead pile threads bound into the top fabric or into the bottom fabric between the weft threads lying one above the other in said top fabric or said bottom fabric, some pile threads being dead pile threads while other pile threads being active pile threads at each pick, and which includes alternately (e) taking the two weft threads to a height corresponding to the top fabric and to a height corresponding to the bottom fabric before inserting the two weft threads one above the other into the shed according to steps (a) and (b) respectively.

2. Method for twin-spool manufacture of a face-to-face fabric according to claim 1, wherein the warp threads include binder warp threads, pile warp threads and tension warp threads, and wherein each pick corresponding to the insertion of the two weft threads into the shed corresponding to the top fabric or into the shed corresponding to the bottom fabric is only carried out after the binder warp threads, pile warp threads and tension warp threads of the fabric in question are taken into such a position relative to the heights of the weft threads that the desired weave patterns of these threads are achieved after the pick.

3. Method for twin-spool manufacture of a face-to-face fabric according to claim 2, wherein the tension warp threads remain at the same height and are used to pull the top fabric and the bottom fabric apart.

4. Method for twin-spool manufacture of a face-to-face fabric according to claim 1, wherein during the insertion of the two weft threads at the top height, the bottom weft thread of said two weft threads is inserted at substantially the same height as the top weft thread of said two weft threads during the insertion of said two weft threads at the bottom height.

5. Method for twin-spool manufacture of a face-to-face fabric according to claim 2, wherein the tension warp threads of the top fabric and the tension warp threads of the bottom fabric remain at their own respective heights during the manufacture of the face-to-face fabric.

6. Method for twin-spool manufacture of a face-to-face fabric according to claim 1, wherein the dead pile threads exist in consecutive picks bound into the top fabric, or bound into the bottom fabric and said dead pile threads bound into the top fabric or into the bottom fabric remain at their own respective heights during the manufacture of the face-to-face fabric.

7. A method for twin-spool manufacture of a face-to-face fabric according to claim 1, in which the warp threads are binder warp threads and in which the active and dead pile threads are pile warp threads and in which the active pile thread is alternately positioned above the shed formed by the binder warp threads before insertion of the two weft threads in the top fabric and is brought below the shed formed by the warp threads before the two weft threads are inserted into the bottom fabric and in which the pile warp threads when they are to be dead pile threads are positioned between the upper and lower weft threads before the two weft threads are inserted into either the upper or lower fabric.

8. Method for twin-spool manufacture of a face-to-face fabric according to claim 1, in which at a given pick there are provided one active pile thread and three dead pile threads, two of said dead pile threads being bound into either the top or bottom fabric and the third dead pile thread being bound into the other of said top or bottom fabrics.

9. Method for twin-spool manufacture of a face-to-face fabric according to claim 7, in which for a particular pick the dead pile warp threads and tension warp threads at the height for either the upper or lower fabric are positioned for insertion between the upper and lower wefts.

10. Face-to-face weaving loom which comprises weaving frames for carrying warp threads and two means each for the insertion of a weft thread between the warp threads, one of said insertion means being disposed above the other, and means for driving the two weft insertion means so as to insert the two respective weft threads together, one above the other, between the warp threads after the latter have been moved by the weaving frames to different heights for weaving a face-to-face fabric, wherein the two means for the insertion of the respective weft threads are driven together by said driving means so that they insert the two weft threads one above the other between the warp threads alternately in a top position and in a bottom position so that the height of the top weft thread when the weft insertion devices are in the bottom position is at substantially the same height as the lower weft thread when the weft insertion devices are at the top position.

* * * * *